US005765477A

United States Patent [19]

Yoshida

[11] Patent Number: 5,765,477

[45] Date of Patent: Jun. 16, 1998

[54] METHOD AND DEVICE FOR PERFORATING FRAMED STENCIL SHEET WITH COLOR INFORMATION MARK

[75] Inventor: Sachiko Yoshida, Inashiki-gun, Japan

[73] Assignees: Riso Kagaku Corporation; Alps Electric Co., Ltd., both of Tokyo, Japan

[21] Appl. No.: 736,820

[22] Filed: Oct. 25, 1996

[30] Foreign Application Priority Data

Oct. 31, 1995 [JP] Japan ..... 7-306859

[51] Int. Cl.[6] ..... B41C 1/14; B41M 5/00

[52] U.S. Cl. ..... 101/128.4; 101/127.1

[58] Field of Search ..... 101/127, 127.1, 101/128.4, 395, 469, DIG. 36

[56] References Cited

U.S. PATENT DOCUMENTS 4,440,080 4/1984 Lyall ..... 101/DIG. 36

4,582,768 4/1986 Takeuchi et al. ..... 101/DIG. 36

FOREIGN PATENT DOCUMENTS 59-062190 4/1984 Japan ..... 101/DIG. 36

61-64470 5/1986 Japan .

2-297490 12/1990 Japan .

2-297491 12/1990 Japan .

3-68469 7/1991 Japan .

*Primary Examiner*—Edgar S. Burr

*Assistant Examiner*—Amanda B. Sandusky

*Attorney, Agent, or Firm*—Oliff & Berridge, PLC

[57] ABSTRACT

In a method or a device for perforating a framed stencil sheet having a frame and a stencil sheet supported by the frame such that at least one sort of primary color image information is made by color separation of input color image information, and the framed stencil sheet is perforated according to the primary color image information to produce a framed stencil master having a printing area for printing the image of the primary color, a color information mark is applied to the framed stencil sheet at a portion thereof outside of the printing area.

2 Claims, 3 Drawing Sheets

METHOD AND DEVICE FOR PERFORATING FRAMED STENCIL SHEET WITH COLOR INFORMATION MARK

BACKGROUND OF THE INVENTION

1. Field of the Invention

The present invention relates to the art of stencil printing, and more particularly, to a method and device for perforating a framed stencil sheet for color printing.

2. Description of the Prior Art

A convenient stencil printing by use of a framed stencil sheet having a frame like the frame of picture and a thermal stencil sheet supported by the frame has got popular in these years, wherein the thermal stencil sheet is made of a lamination of thermoplastic film and Japanese paper or gauze and adapted to be perforated by thermal melting. In the following descriptions and the appended claims, "framed stencil sheet" refers generally to such a framed stencil sheet through before and after the perforation. When it is particularly desired to specify that a framed stencil sheet is already perforated for the purpose of stencil printing, the perforated stencil sheet is referred to as "framed stencil master". Since such a framed stencil sheet is relatively easily and precisely positioned for the perforation process as well as printing process, it is tried to make a color printing by repeating different primary color printings one over the other.

Conventionally, the stencil printing using such a framed stencil sheet has been generally made by manual work. However, in view of the small sizing of electronic devices according to the recent developments of electronic technology and the reduction of price of those devices, it is being developed to read in a color image by an electronic device with separation of the color image into images according to different primary colors and to perforate a plurality of framed stencil sheets separately corresponding to the respective primary color images such that a set of framed stencil masters for a color printing are prepared. When such primary color stencil masters are automatically prepared by the device, it would happen that some primary color stencil masters are mixed up such that a mistake of recognition of a certain primary color stencil master is noted only after the printing was actually done with no possibility of re-inking of the stencil master.

SUMMARY OF THE INVENTION

In anticipation of such a problem, it is a primary object of the present invention to provide a method and a device for perforating a framed stencil sheet prepared against such a trouble.

According to the present invention, the above-mentioned object is accomplished by a method for perforating a framed stencil sheet having a frame and a stencil sheet supported by said frame, comprising:

a color separation process for generating at least one sort of color image information based upon input image information;

a perforation process for perforating said framed stencil sheet according to said color image information to produce a framed stencil master having a printing area; and a marking process for applying a color information mark to said framed stencil sheet at a portion thereof outside of said printing area thereof, or, by a device for perforating a framed stencil sheet having a frame and a stencil sheet supported by said frame, comprising:

a color separation means for generating at least one sort of color image information based upon input image information;

a perforation means for perforating said framed stencil sheet according to said color image information to produce a framed stencil master having a printing area; and a marking means for applying a color information mark to said framed stencil sheet at a portion thereof outside of said printing area thereof.

In the above-mentioned method and device, said portion may be a part of said frame.

Further, in the above-mentioned device, said color information mark application means may be a heating means which generates a thermal trace at a portion of said framed stencil sheet.

Such a heating means may be at least a part of said perforation means operated at a second position relative to said framed stencil sheet different from a first position relative to said framed stencil sheet for said perforation thereof.

Or, in the above-mentioned device, said color information mark application means may be a stamp means which provides a stamped image at a part of said framed stencil sheet, or a boring means which forms a bore at a part of said framed stencil sheet.

In either case, said color information mark application means may apply said color information mark at a part of said frame.

By such a method or a device as mentioned above, each framed stencil master prepared for color printing automatically bears a color information mark which shows by what color the framed stencil master is to be inked for printing. Thus, the operator is exempt from a trouble of remembering or recording such color information with respect to each stencil master, and it is avoided that a stencil sheet elaborately perforated and inked is uselessly discarded, with an accompanying loss of ink.

Since the framed stencil sheet of this kind is generally so constructed that a rectangular thermal stencil sheet is pasted at a peripheral portion thereof laid on along a rectangular frame made of cardboard, particularly when the color information mark application means is a heating means for generating a thermal trace at a part of the framed stencil sheet, such a thermal trace may conveniently be generated at the peripheral portion of the rectangular thermal stencil sheet laid over the frame to be out of the printing area of the stencil sheet.

However, the part of the stencil sheet applied with the color information mark by a heating means need not necessarily be a part of the thermal stencil sheet but may be a part of the frame which is provisionally applied with an appropriate thermally color generating material.

Further, when the color information mark application means is provided by at least a part of the perforation means adapted to be operated also as said color information mark application means, no additional hardware means is required for providing the color information mark application means.

When the color information mark is applied by the stamping means or the boring means, any conventional means conveniently available may be optionally used.

BRIEF DESCRIPTION OF THE DRAWING

In the accompanying drawing.

DESCRIPTION OF EMBODIMENTS

In the following, the present invention will be described in more detail in the form of embodiments with reference to the accompanying drawing.

Figure 1:
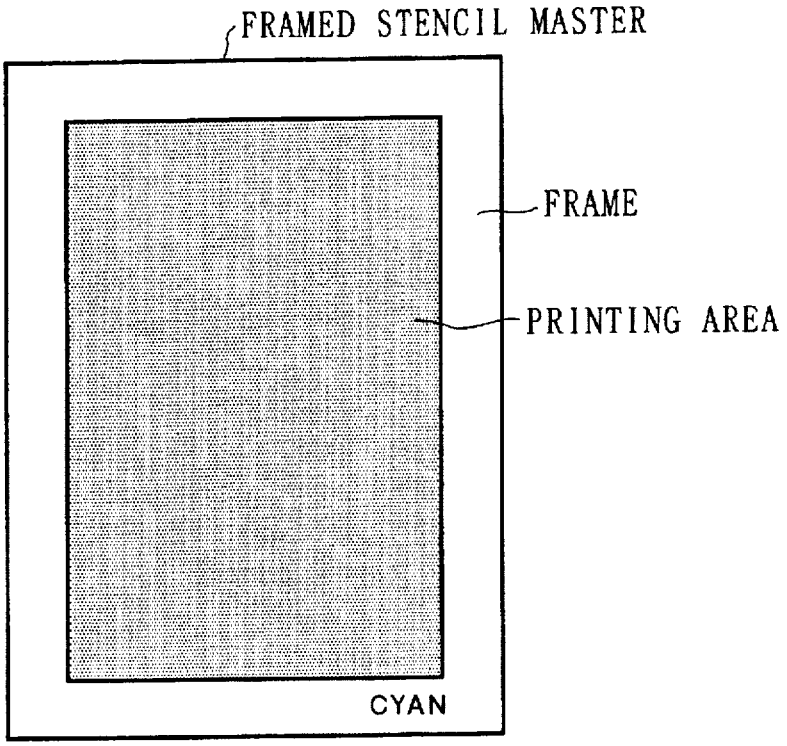
FIG. 1 is a plan view of an example of the framed stencil master applied with a color information mark according to the present invention.
Figure 2:
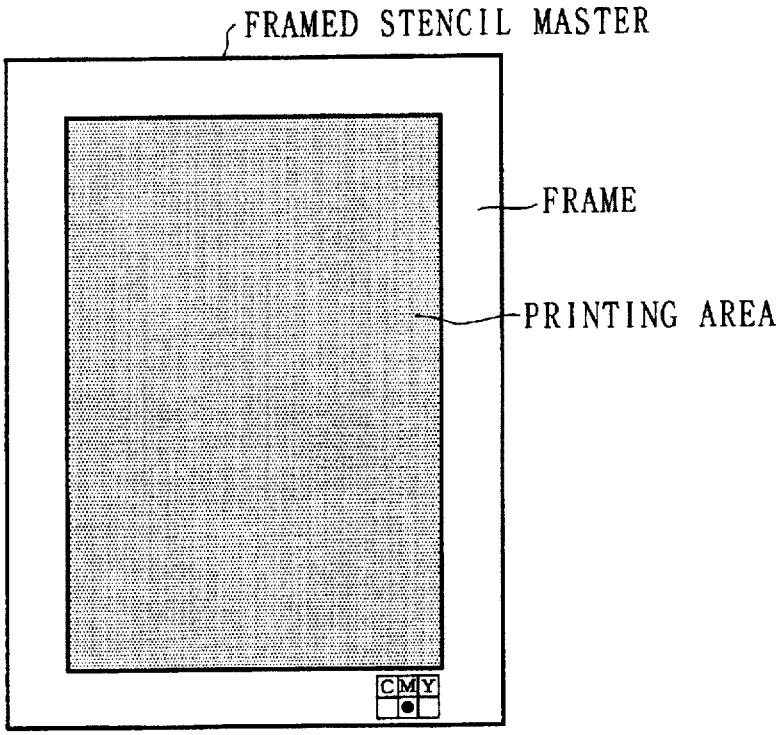
FIG. 2 is a plan view of another example of the framed stencil master applied with a color information mark according to the present invention.

Referring to FIG. 1 showing, in a plan view, an example of the framed stencil master prepared from a framed stencil sheet such that a stencil sheet supported by a rectangular frame is perforated according to an image (not illustrated), wherein the frame of the stencil sheet is applied with a color information mark "CYAN" at a part thereof according to the present invention, said mark indicating that this stencil master is to be used with ink of cyan color. In the example shown in FIG. 2, the frame is provided with indication boxes bearing notations of "C" (cyan), "M" (magenta) and "Y" (yellow), so that a pertinent box is put a mark, accompanying the perforation of the stencil sheet for a particular primary color printing. (The stencil master of FIG. 2 is prepared for a printing by magenta.) The stencil masters shown in FIGS. 1 and 2 are each prepared from a framed stencil sheet having a rectangular frame of cardboard and a rectangular thermal stencil sheet pasted at a peripheral portion thereof along on one face of the cardboard frame, and the letters "CYAN" and the round mark are respectively thermally generated at the peripheral portion of the thermal stencil sheet pasted over the frame.

Figure 3:
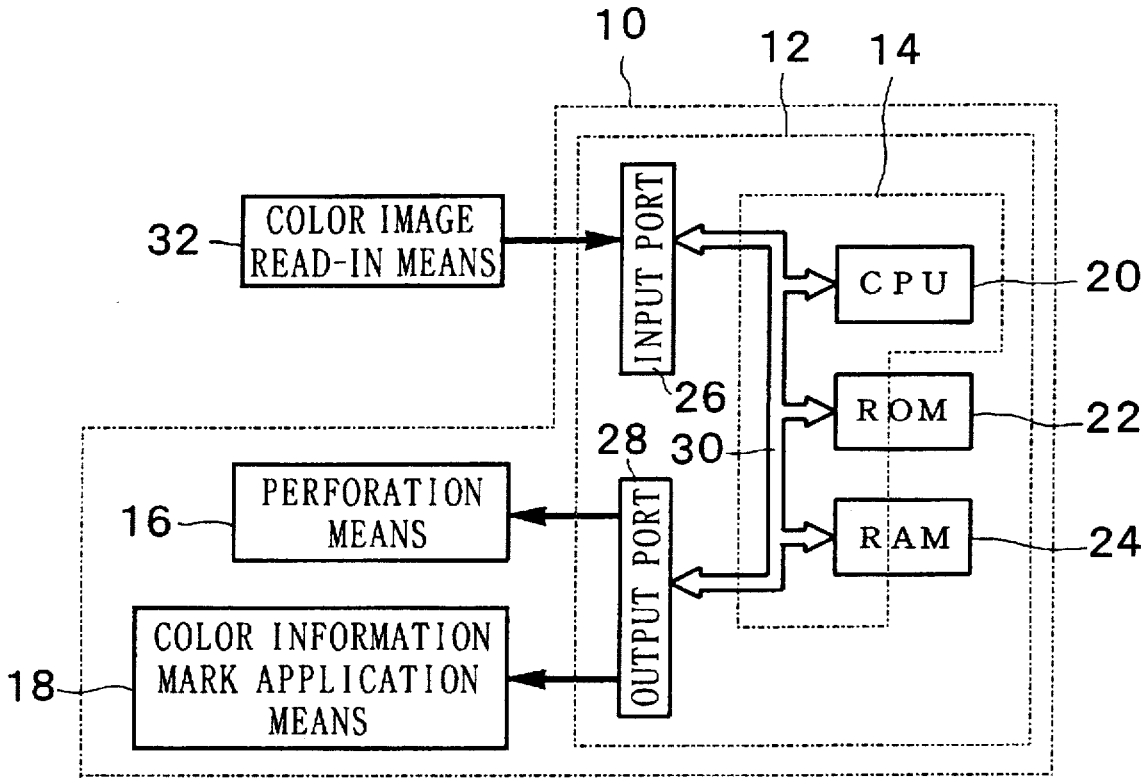
FIG. 3 is a diagrammatic illustration of the framed stencil sheet perforation device according to the present invention.

FIG. 3 shows diagrammatically the construction of the framed stencil sheet perforation device according to the present invention. In the figure, the device generally indicated by 10 includes a micro-computer to operate as a control means 12 for overall automatic operation of the device, including a functional part operating as a color separation means 14 which separates input color image into images according to different primary colors, a perforation means 16, and a color information mark application means 18. The micro-computer constructing the control means 12 has central processing unit (CPU) 20, read only memory (ROM) 22, random access memory (RAM) 24, input port means 26, output port means 28, and common bus 30 interconnecting these units. The device 10 is adapted to be supplied with input color image information from a color image read-in means 32 such as a scanner, but input color image information may be created in the micro-computer. The perforation means 16 may be such a device that has an array of fine thermal heads known as thermal print heads each of which generates a fine heat spot according to electronic information supplied thereto.

The control means 12 including the color separation means 14 as a functional part thereof and constructed by a micro-computer and the perforation means 16 are available based upon known art, and therefore, these parts construct no essential part of the present invention, although these parts are essential for the construction of the framed stencil sheet peroration device according to the present invention.

The color information mark application means 18 is a means to apply a color information mark regarding the color of the ink to be used for the perforated stencil master at a part of the framed stencil sheet outside of a printing area thereof, and is therefore a means different from the perforation means 16 as a matter of technical concept. However, in an embodiment of the present invention, the color information mark application means may be provided by a part of the perforation means, as a matter of hardware. In the appended claims of the present application, the "device" for perforating a framed stencil sheet is defined, as a technical concept, to comprise the color separation means 14, the perforation means 16, and the color information mark application means 18.

Figure 4:
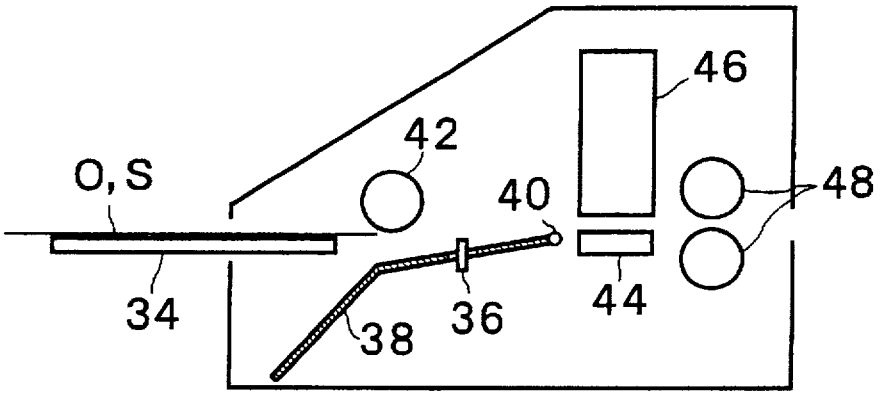
FIG. 4 is a diagrammatic illustration of an embodiment of the framed stencil sheet perforation device according to the present invention.

FIG. 4 shows diagrammatically the construction of an embodiment of the framed stencil sheet perforation device according to the present invention. The device is adapted to read in a color image from an original, separate the color image into respective primary color images, and perforate stencil sheets to produce stencil masters for the respective primary color printings.

An original O to be read in is fed on a tray 34 to be moved rightward in the figure until its front end abuts against a fixed stop 36. Then, after a selection of read in mode by a mode selection button not shown in the figure, by a start button not shown in the figure being pressed, a movable guide plate 38 is turned clockwise in the figure around a pivot axis 40 to come above the stop 36 by a drive mechanism not shown in the figure, so that a front end portion of the original O is nipped between the movable guide plate 38 and a feed-in roller 42. Then the feed-in roller 42 is automatically driven counter-clockwise, whereby the original O is transferred through a position above a platen 44. Opposed to the platen 44 from above there is provided a CCD/TPH unit 46, wherein CCD refers to "charge coupled device" which itself is known as a device for generating a corresponding electric signal according to an input of photo energy, and "TPH" refers to the "thermal print head" described above. The CCD/TPH unit 46 reads in the image of the original by a CCD portion thereof to generate an electric image information signal corresponding to the original image such that the electric signal is stored in RAM 24 and processed for separation into respective primary color image signals by CPU 20 according to programs stored in ROM 22. The original 0 is fed out of the CCD/TPH unit by a pair of feed-out rollers 48.

For perforating a framed stencil sheet S to obtain a stencil master for printing a particular primary color image, the mode selection button not shown in the figure is operated to select a stencil perforation mode for the particular primary color image, and the framed stencil sheet S is forwarded on the tray 34 rightward until its front end abuts the stop 36. Similarly, by the start button not shown in the figure being pressed, the drive mechanism not shown is operated to turn the plate 38 clockwise in the figure around the pivot axis 40, with start of rotation of the feed-in roller 42, so that the framed stencil sheet S is fed through a position above the platen 44. The CCD/TPH unit 46 now operates with the TPH portion thereof to perforate the framed stencil sheet S according to the corresponding primary color image signal so that the framed stencil sheet is perforated as a master for the particular primary color printing.

Together with the execution of such a perforation of the framed stencil sheet, at any convenient time point, preferably in the end or in the beginning of the perforation where a transverse side of the frame is opposed by the CCD/TPH unit 46, the TPH portion is operated by a signal different from the image perforation signal so as to apply a color information mark such as "CYAN" in FIG. 1 or the round mark in FIG. 2 to a pertinent portion of the stencil sheet corresponding to the primary color for the printing for which the perforation is executed. When the color printing is executed by a combination of three primary color printings, similar perforation processes are repeated to produce two more framed stencil masters, with the corresponding perforations of the stencil sheet portion, accompanied by the application of the corresponding color information marks.

Figure 5:
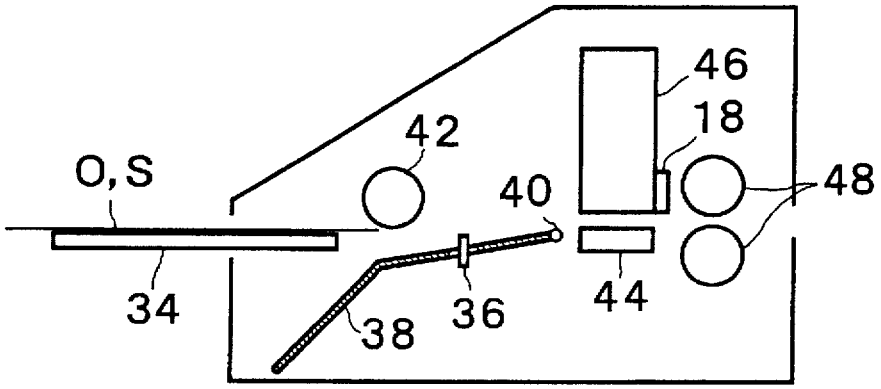
FIG. 5 is a diagrammatic illustration similar to FIG. 4, showing another embodiment of the framed stencil sheet perforation device according to the present invention.

Although the color information mark can be applied to the framed stencil sheet by using a part of the CCD/TPH unit 46, a separate color information mark application means may be provided, as diagrammatically shown by 18 in FIG. 5 which shows a modification of the embodiment shown in FIG. 4 only in this respect.

Further, although the perforation means and the color information mark application means are shown in FIGS. 4 and 5 as constructed in a common device with the image read in and color separation means, the perforation means and the color information mark application means may be constructed as a separate device according to the convenience of the design of the framed stencil sheet perforation device.

Although the present invention has been described in detail in the above with respect to particular embodiments thereof, it will be apparent for those skilled in the art that various modifications are possible without departing from the spirit of the present invention.

I claim:

1. A method for perforating a framed stencil sheet having a frame and a stencil sheet supported by said frame, comprising:

provisionally applying a thermally color generating material to a part of said frame;

a color separation process for generating at least one sort of color image information based upon input image information;

a perforation process using a thermal print head for perforating said framed stencil sheet according to said color image information to produce a framed stencil master having a printing area; and a marking process using said thermal print head for generating a color information mark in said framed stencil sheet at said part of said frame bearing said thermally color generating material.

2. A device for perforating a framed stencil sheet having a frame and a stencil sheet supported by said frame, said frame including a part thereof provisionally applied with a thermally color generating material, comprising:

a color separation means for generating at least one sort of color image information based upon input image information;

a perforation means using a thermal print head for perforating said framed stencil sheet according to said color image information to produce a framed stencil master having a printing area; and a marking means using said thermal print head for generating a color information mark in said framed stencil sheet at said part of said frame bearing said thermally color generating material.

* * * * *